US005820274A

United States Patent [19]

Fukuoka et al.

[11] Patent Number: 5,820,274

[45] Date of Patent: Oct. 13, 1998

[54] COLOR PRINTER AND INK RIBBON THEREFOR

[75] Inventors: Hiroaki Fukuoka; Junji Kawano, both of Ise, Japan

[73] Assignee: Shinko Electric Co., Ltd., Tokyo, Japan

[21] Appl. No.: 652,906

[22] Filed: May 23, 1996

[30] Foreign Application Priority Data

May 25, 1995 [JP] Japan ..... 7-126920

[51] Int. Cl.[6] ..... B41J 2/315; B41J 31/00

[52] U.S. Cl. ..... 400/120.02; 400/120.18; 400/237; 400/240.4

[58] Field of Search ..... 400/120.02, 120.18, 400/120.03, 120.04, 237, 240, 240.4

[56] References Cited

U.S. PATENT DOCUMENTS 4,558,329 12/1985 Honda ..... 400/240.3
5,478,157 12/1995 Kohno et al. ..... 400/120.18
5,486,057 1/1996 Skinner et al. ..... 400/120.02
5,492,421 2/1996 Fushimi et al. ..... 400/120.02
5,609,425 3/1997 Kawano et al. ..... 400/120.08

*Primary Examiner*—John S. Hilten
*Attorney, Agent, or Firm*—Darby & Darby

[57] ABSTRACT

A compact color printer having a Y head (2), an M head (9), a C head (16), platen rollers (8, 15, 22) and a multi-time ink ribbon (23) wherein yellow ink (23*y*), magenta ink (23*m*) and cyan ink (23*c*) each having effective lengths B are sequentially on a substrate (23*o*) with a pitch P. When a line L1 of the printing paper (1) and an edge (23*ya*) of the yellow ink (23*y*) are positioned over a line position y1, the Y head (2) prints the color yellow; when a line L1 of the printing paper 1 and an edge (23*ma*) of the magenta ink (23*m*) are positioned over a line position y2, the M head (9) prints the color magenta; and when a line L1 of the printing paper (1) and an edge (23*ca*) of the cyan ink (23*c*) are positioned over a line position y3, the C head (16) prints the color cyan.

15 Claims, 8 Drawing Sheets

COLOR PRINTER AND INK RIBBON THEREFOR

BACKGROUND OF THE INVENTION

1. Field of the Invention

The present invention relates to a thermal type color printer and an ink ribbon therefor.

2. Background Art

FIG. 8 is a side view showing an outline of the construction of a printing section of a conventional color printer (first construction example). In FIG. 8, numeral 1 indicates a printing paper which is stored in a blank paper cassette (not shown). The length of the printing paper 1 is such that L lines of line width k can be printed thereon. Hereunder, the length of the printing paper 1 in the feed direction is designated as L lines.

Numeral 2 indicates a Y head. The Y head 2 is a thermal head which is used when printing yellow ink onto the printing paper 1. Numeral 3 indicates an ink ribbon with yellow ink applied to the whole surface. The ink ribbon 3 is wound around a feed reel 4 in an initial condition, and during printing is wound up onto a take-up reel 5 via guide rollers 6, 7. Numeral 8 indicates a platen roller provided beneath the Y head 2, which is rotated by a drive unit (not shown) in the direction of arrow $Z_1$ to thereby convey the print paper 1 in the direction of arrow $Z_3$.

Numeral 9 indicates an M head provided at a spacing d to the left of the Y head 2. The M head 9 is a thermal head which is used when printing magenta ink onto the printing paper 1. Numeral 10 indicates an ink ribbon with magenta ink applied to the whole surface. The ink ribbon 10 is wound around a feed reel 11 in an initial condition, and during printing is wound up onto a take-up reel 12 via guide rollers 13, 14. Numeral 15 indicates a platen roller provided beneath the M head 9.

Numeral 16 indicates a C head provided at a spacing d to the left of the M head 9. The C head 16 is a thermal head which used when printing cyan ink onto the printing paper 1. Numeral 17 indicates an ink ribbon with cyan ink applied to the whole surface. The ink ribbon 17 is wound around a feed reel 18 in an initial condition, and during printing is wound up onto a take-up reel 19 via guide rollers 20, 21. Numeral 22 indicates a platen roller provided beneath the C head 16

With the above construction, at first a drive device (not shown) is operated so that the platen rollers 8, 15 and 22 are respectively rotated in the direction of arrow $Z_1$, after which the printing paper 1 is fed in the direction of arrow $Z_3$ by a paper feed roller (not shown). Then once the L1 line of the printing paper 1 has been conveyed to above the platen roller 8, rotation of the platen rollers 8, 15 and 22 is stopped, and the Y head 2 is lowered to press the ink ribbon 3 against the platen roller 8 with the printing paper 1 therebetween.

A current is then supplied to the Y head 2 to heat a heating element in the Y head 2. As a result, the yellow ink of the ink ribbon 3 is melted and yellow ink is printed on the L1 line of the printing paper 1. Once the yellow ink has been printed on the L1 line, the Y head 2 is raised to release the contact pressure.

After this, the platen rollers 8, 15 and 22 are again respectively rotated through a predetermined angle in the direction of arrow $Z_1$, so that the printing paper 1 is conveyed by the line width k in the direction of arrow $Z_3$. At the same time, the take-up reel 5 is rotated so that the ink ribbon 3 is fed by the line width k in the direction of arrow $Z_2$. Then as with the abovementioned operation, yellow ink is printed on the L2 line of the printing paper 1. After this the same operation is repeated so that yellow ink is successively printed on the L3 and subsequent lines of the printing paper 1.

Yellow ink printing with the Y head 2 is thus progressed, and once the L1 line of the printing paper 1 has been conveyed to above the platen roller 15, the M head 9 is lowered to press the ink ribbon 10 against the platen roller 15 with the printing paper 1 therebetween. Then as with the yellow ink printing with the Y head 2, magenta ink is printed over the yellow ink which has already been printed on the L1 line of the paper 1. After this the same operation is repeated so that magenta ink is successively printed on the L2 and subsequent lines of the printing paper 1.

Magenta ink printing with the M head 9 is thus progressed, and once the L1 line of the printing paper 1 has been conveyed to above the platen roller 22, then as with the abovementioned operation for the Y head 2, cyan ink is further printed over the yellow ink and the magenta ink which has already been printed on the L1 line of the printing paper 1. After this the same operation is repeated so that cyan ink is successively printed on the L2 and subsequent lines of the printing paper 1. Then once the cyan ink has been printed on the LL line of the printing paper 1, all printing is stopped.

Now with the operation of the conventional color printer as described above (first construction example), an example has been described wherein the respective inks of yellow, magenta and cyan are printed over each other on all of the lines (L1 line–LL line) of the printing paper 1. The printing can however be carried out in a single color or a mixture of any two colors according to the printing data.

With the conventional color printer (first construction example) as described above, single colors of yellow, magenta or cyan, or any of two or three colors are printed on the printing paper 1, to thus obtain respective colors of yellow, magenta, cyan, red, green, blue and black. Moreover, by applying a grading to the respective colors, then color printing in for example 12, 600,000 colors can be realised.

FIG. 9 is a side view showing an outline of the construction of a printing section of a conventional color printer (second construction example). In FIG. 9, numeral 50 indicates a thermal head having a heating section 50*a* on a tip end thereof, which is moved in the direction of arrow Zu or arrow Zd in FIG. 9 by means of head motor (not shown). Numeral 51 indicates a color ink ribbon to which yellow ink, magenta ink, cyan ink, black ink, and an overcoat material has been successively applied. The color ink ribbon 51 is wound around a feed reel 52 in an initial condition, and during printing is wound up onto a take-up reel 55 via guide rollers 53, 54.

The structure of the color ink ribbon 51 is shown in FIG. 10. The color ink ribbon 51 has a band shape base material 51*o* to which yellow ink 51Y, magenta ink 51M, cyan ink 51C, black ink 51BK, and overcoat material 510C is successively applied at spacing L2 in the lengthwise direction (direction of arrow $Z_4$). The overcoat material 510C is a protective material for protecting the printing surface from wear and ultraviolet rays. The spacing L2 is the sum of a distance x1 (refer to FIG. 9) between a mark detection sensor 56 (to be explained later) and the heating section 50*a* of the thermal head 50, and a lengthwise length L1 of a card 58.

Front portions of the respective inks are respectively formed with a Y color Mark $M_y$, an M color Mark $M_M$, a C color mark $M_C$, a BK color mark $M_{BK}$, and an OC Mark $M_{OC}$, for detecting the front portions. These marks are detected by the mark detection sensor 56 shown in FIG. 9.

In FIG. 9, numeral 57 indicates a platen roller provided beneath the thermal head 50, which is rotated by a card feed motor (not shown) in the direction of arrows $Z_8$ or $Z_6$. The card 58 is for example an ID card or a credit card, made from rigid vinyl chloride (PVC) or the like.

With the above construction, when a print start command is issued from a control section (not shown), the take-up reel 55 in FIG. 9 is rotated in the direction of arrow $Z_{10}$ so that the color ink ribbon 51 is fed in the direction of arrow $Z_4$. Then when the Y color Mark $M_Y$ (refer to FIG. 10) is detected by the mark detection sensor 56, the control section stops rotation of the take-up reel 55.

The card feed motor (not shown) is then rotated so that the card 58 is conveyed in the direction of arrow $Z_5$. Then once the front edge 58*a* of the card 58 has been conveyed to a print start position Pp, the control section stops the card feed motor. The control section then drives the head motor (not shown), thus lowering the thermal head 50 in the direction of arrow Zd so that the card 58 is pressed thereby with the color ink ribbon 51 therebetween.

The control section then respectively rotates the take-up reel 55 and the platen roller 57 at identical speeds, and yellow printing data is successively supplied one line at a time to the heating section 50*a*. The color ink ribbon 51 is thus fed in the direction of arrow $Z_4$ (FIG. 9), with the card 58 being conveyed in the direction of arrow $Z_5$ at the same speed as the color ink ribbon 51. As a result, yellow ink is successively printed on the surface of the card 58, one line at a time from the front edge 58*a* to a rear edge 58*b*.

Then when the M color mark $M_M$ shown in FIG. 10 is detected by the mark detection sensor 56, the control section stops rotation of the take-up reel 55 and the platen roller 57. At this time, the rear edge 58*b* of the card 58 is positioned at the print start Position $P_p$. That is to say, the yellow ink printing for the card 58 is completed.

The head motor is then driven by the control section so that the thermal head 50 is moved in the direction of arrow Zu to thereby release the contact pressure on the card 58.

After this, the platen roller 57 is reverse rotated under control from the control section, in the direction of arrow $Z_8$, causing the card 58 to be conveyed back in the direction of arrow $Z_7$. Then, once the front edge 58*a* of the card 58 has been positioned at the print start Position Pp, the control section stops rotation of the platen roller 57. The above-mentioned process is then repeated to carry out printing on the card 58 in the order of; magenta ink, cyan ink, black ink and overcoat material.

With the conventional color printer as described above (first construction example), ink ribbons 3, 10 and 17 corresponding to the respective colors are required for the Y head 2, the M head 9, and the C head 16 respectively. Hence a total of 6 reels, namely the feed reels 4, 11 and 18 and the take-up reels 5, 12 and 19 must be provided, so that the space d must be made large. There is thus the disadvantage in that the overall size of the printer must be large.

Moreover, with the conventional color printer as described above (first construction example), in order to minimize the size of the color printer, then the feed reels 4, 11 and 18 and the take-up reels 5, 12 and 19 cannot be large, and hence the capacity (ribbon length) of the respective ink ribbons 3, 10 and 17 cannot be large. Consequently, the ink ribbons 3, 10 and 17 must be frequently replaced, which can be exceedingly troublesome.

In addition, with the conventional color printer as described above (first construction example), since the usage quantity of the respective colors differs, then the respective replacement periods for the ink ribbons 3, 10 and 17 vary. Hence replacement must be carried out frequently, with the problem of increased maintenance costs.

Moreover, with the conventional color printers as described above (first and second construction examples), since the conveying speed of printing paper 1 (the card 58) and the feed speed of the respective ink ribbons 3, 10 and 17 (the color ink ribbon 51) are the same, then for example in the case where printing is to be carried out over the whole surface of the printing paper 1 (the card 58), then at least an amount of the ink ribbon for the length L lines of the printing paper 1 (the card 58) is consumed. The cost of the ink ribbon per sheet of printing paper (per card), ie. printing cost, is thus increased.

SUMMARY OF THE INVENTION

The present invention has been developed in view of the above situation with the object of providing a small size color printer and ink ribbon therefor, wherein ink ribbon replacement maintenance is easy, and the printing cost per object to be printed is low.

According to a first aspect of the present invention there is provided a color printer comprising; a plurality of thermal heads arranged at predetermined spacing along a printing paper feed direction, an ink ribbon with ink respectively corresponding to the plurality of thermal heads successively applied thereto, with a feed direction length of the respective ink regions 1/N or slightly greater than 1/N (where N is a positive integer) of a length of a printing portion of the printing paper, and a drive device for driving the ink ribbon at a speed of 1/N of the conveying speed of the printing paper.

According to a second aspect of the present invention there is provided a color printer as described above, wherein the concentration of ink on said ink ribbon is N times the normal concentration.

According to a third aspect of the present invention there is provided a color printer as described above further comprising; a plurality of storage devices respectively corresponding to the plurality of thermal heads, for storing printing data, and a control device for reading the printing data in the storage devices in synchronous with the conveying of the printing paper, and outputting this to the thermal heads.

According to a fourth aspect of the present invention there is provided a color printer as described above, wherein a spacing S between the plurality of thermal heads is $$S=\{L+N(a+b)\}/(N-1),$$

where:

L is a converted line number length for the printing portion of the printing paper, a is an ink adjustment length, and b is an ineffective length which depends on mechanical design conditions.

According to a fifth aspect of the present invention there is provided an ink ribbon characterised in having a band shape base material, with a plurality of sublimating type inks and pigment type inks successively applied to the base material, with a feed direction length of the sublimating type ink region as 1/N or slightly larger than 1/N (where N is a positive integer) of a length of a printing portion of an object to be printed, and a feed direction length of the pigment type ink region equal to or slightly greater than the length of the printing portion of the object to be printed.

According to a sixth aspect of the present invention there is provided a color printer comprising; a thermal head arranged along a feed direction of an object to be printed, an ink ribbon with a plurality of sublimating type inks and pigment type inks successively applied thereto, with a feed direction length of the sublimating type ink region as 1/N or slightly greater than 1/N (where N is a positive integer) of a length of a printing portion of the object to be printed, and a feed direction length of the pigment type ink region equal to or slightly greater than the length of the printing portion of the object to be printed, a drive device for driving the ink ribbon at a speed of 1/N of the conveying speed of the object to be printed when the sublimating type ink is being printed on the object to be printed, and for driving the ink ribbon at the same speed as the conveying speed of the object to be printed when the pigment type ink is being printed on the object to be printed.

According to a seventh aspect of the present invention there is provided a color printer as described above, incorporating a judgement device for judging if the ink to be printed on the object to be printed is the sublimating type ink or the pigment type ink, and the drive device drives the ink ribbon based on the judgement results of the judgement device.

According to a eighth aspect of the present invention there is provided a color printer as described above, wherein an overcoat material for protecting the printing surface is applied to the ink ribbon over the same or a greater length than the printing portion of the object to be printed, and the drive device drives the ink ribbon at the same speed as the conveying speed of the object to be printed when the overcoat material is being printed on the object to be printed.

According to an ninth aspect of the present invention there is provided a color printer as described above, wherein a fixing material for increasing the fixing strength of the sublimating type ink is applied to the ink ribbon over the same or a greater length than the printing portion of the object to be printed, and the drive device drives the ink ribbon at the same speed as the conveying speed of the object to be printed when the fixing material is being printed on the object to be printed.

According to a tenth aspect of the present invention there is provided a color printer comprising;a thermal head arranged along a feed direction of an object to be printed, an ink ribbon with a plurality of sublimating type inks and pigment type inks successively applied thereto, with a feed direction length of said sublimating type ink region as 1/N or slightly greater than 1/N (where N is a positive integer) of a length of a printing portion of said object to be printed, and a feed direction length of said pigment type ink region equal to or slightly greater than the length of the printing portion of said object to be printed, drive means for driving said ink ribbon at a speed of 1/N of the conveying speed of said object to be printed when said sublimating type ink is being printed on said object to be printed, and for driving said ink ribbon at the same speed as the conveying speed of said object to be printed when said pigment type ink is being printed on said object to be printed, a plurality of storage means for storing printing data, and control means for reading said printing data in said storage means in synchronous with the conveying of said object to be printed, and outputting said printing data to said thermal head.

According to a eleventh aspect of the present invention there is provided a color printer comprising; a thermal head arranged along a feed direction of an object to be printed, an ink ribbon with a plurality of sublimating type inks and pigment type inks successively applied thereto, with a feed direction length of said sublimating type ink region as 1/N or slightly greater than 1/N (where N is a positive integer) of a length of a printing portion of said object to be printed, and a feed direction length of said pigment type ink region equal to or slightly greater than the length of the printing portion of said object to be printed, drive means for driving said ink ribbon at a speed of 1/N of the conveying speed of said object to be printed when said sublimating type ink is being printed on said object to be printed, and for driving said ink ribbon at the same speed as the conveying speed of said object to be printed when said pigment type ink is being printed on said object to be printed, judgement means for judging if the ink to be printed on said object to be printed Is said sublimating type ink or said pigment type ink, a plurality of storage means for storing printing data, and control means for reading said printing data in said storage means in synchronous with the conveying of said object to be printed, and outputting said printing data to said thermal head, and said drive means drives said ink ribbon based on the judgement results of said judgement means.

According to a twelfth aspect of the present invention there Is provided a color printer comprising; a thermal head arranged along a feed direction of an object to be printed, an ink ribbon with a plurality of sublimating type inks and pigment type inks successively applied thereto, with a feed direction length of said sublimating type ink region as 1/N or slightly greater than 1/N (where N is a positive integer) of a length of a printing portion of said object to be printed, and a feed direction length of said pigment type ink region equal to or slightly greater than the length of the printing portion of said object to be printed, drive means for driving said ink ribbon at a speed of 1/N of the conveying speed of said object to be printed when said sublimating type ink is being printed on said object to be printed, and for driving said ink ribbon at the same speed as the conveying speed of said object to be printed when said pigment type ink is being printed on said object to be printed, a plurality of storage means for storing printing data, and control means for reading said printing data in said storage means in synchronous with the conveying of said object to be printed, and outputting said printing data to said thermal head, an overcoat material for protecting the printing surface is applied to said ink ribbon over the same or a greater length than the printing portion of said object to be printed, and said drive means drives said ink ribbon at the same speed as the conveying speed of said object to be printed when said overcoat material is being printed on said object to be printed.

According to a thirteenth aspect of the present invention there is provided a color printer comprising; a thermal head arranged along a feed direction of an object to be printed, an ink ribbon with a plurality of sublimating type inks and pigment type inks successively applied thereto, with a feed direction length of said sublimating type ink region as 1/N or slightly greater than 1/N (where N is a positive integer) of a length of a printing portion of said object to be printed, and a feed direction length of said pigment type ink region equal to or slightly greater than the length of the printing portion of said object to be printed, drive means for driving said ink ribbon at a speed of 1/N of the conveying speed of said object to be printed when said sublimating type ink is being printed on said object to be printed, and for driving said ink ribbon at the same speed as the conveying speed of said object to be printed when said pigment type ink is being printed on said object to be printed, a plurality of storage means for storing printing data, and control means for reading said printing data in said storage means in synchronous with the conveying of said object to be printed, and outputting said printing data to said thermal head, a fixing material for increasing the fixing strength of said sublimating type ink is applied to said ink ribbon over the same or a greater length than the printing portion of said object to be printed, and said drive means drives said ink ribbon at the same speed as the conveying speed of said object to be printed when said fixing material is being printed on said object to be printed.

With the present invention according to the first aspect, initially when a power source is switched on, the printing paper is supplied and the drive device operated to feed the ink ribbon at a speed of 1/N of the conveying speed of the printing paper. Then when a first line of the printing paper, and one edge of the ink ribbon ink corresponding to the thermal head, are together positioned directly beneath the thermal head, a current is supplied to the thermal head to heat the thermal head thus melting the ink. As a result the ink is printed on the printing paper. The above process is then repeated so that printing is carried out on the second and subsequent lines of the printing paper 1. Then when the first line of the printing paper and one edge of the next ink ribbon ink corresponding to the thermal head are together positioned directly beneath the next thermal head, the ink is printed over the already printed Ink in the same manner as for the first thermal head printing operation. Printing is then carried out in a similar manner with the remaining thermal heads, with the color printing being realized by overprinting with the respective inks. In this way one sheet of printing paper can be printed within an ink region of the ink ribbon which is 1/N or slightly greater than 1/N of the printing portion of the printing paper.

With the invention according to the third aspect, the control device reads printing data from the storage device in synchronous with the conveying of the printing paper, and outputs this to the thermal heads.

DETAILED DESCRIPTION OF THE PREFERRED EMBODIMENTS

As follows is a description of embodiments of the present invention with reference to the figures.

First Embodiment

FIG. 1 is a diagram showing an outline of the construction of a printing section of a color printer according to a first embodiment of the present invention; FIG. 1A being a side view, and FIGS. 1B–1D being plan views of a multi time ink ribbon 23 shown In FIG. 1A.

Figure 1A:
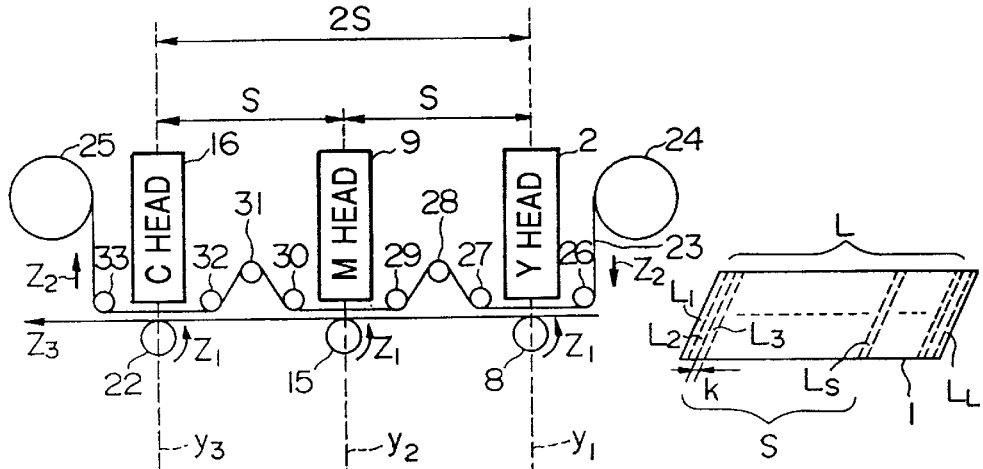
FIGS. 1A–1D are a diagram showing an outline of the construction of a printing section of a color printer according to a first embodiment of the present invention.
Figure 8:
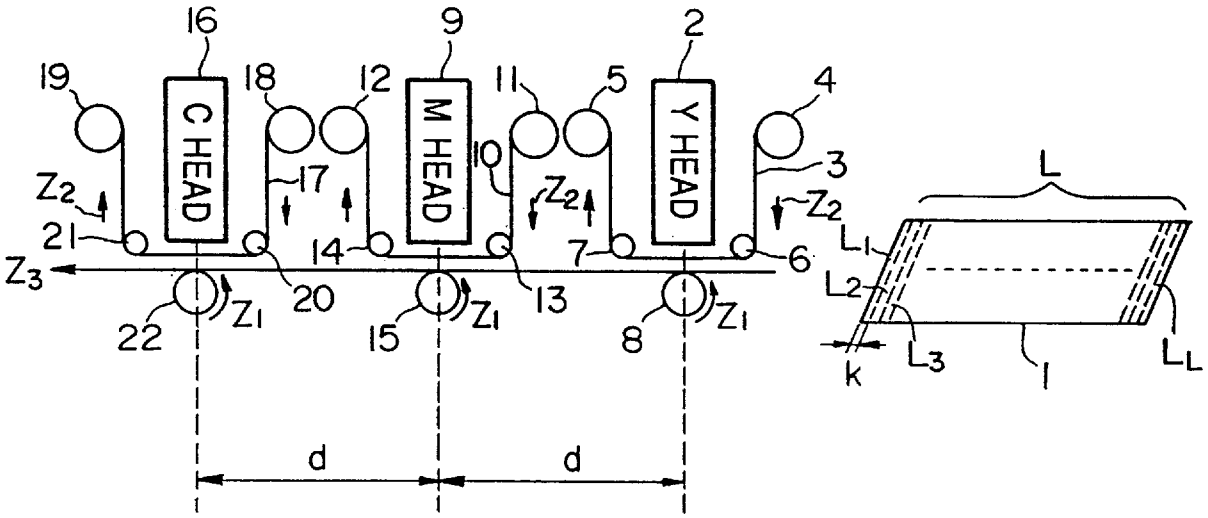
FIG. 8 is a side view showing an outline of the construction of a printing section of a conventional color printer (first construction example)

In FIG. 1A, parts corresponding to the respective parts of FIG. 8 are indicated with the same symbol and description is omitted. With the printing section of the color printer shown in FIG. 1A, instead of the ink ribbons 3, 10 and 17, the feed reels 4, 11 and 18, the take-up reels 5, 12 and 19, and the guide rollers 6, 7, 13, 14, 20 and 21 shown in FIG. 8, there is provided a multi time ink ribbon 23, a feed reel 24, a take-up reel 25, and guide rollers 26–33. Moreover, in FIG. 1A, the respective spacings of the Y head 2, the M head 9, and the C head 16 are made S. This spacing S is discussed later on.

Figure 1B:
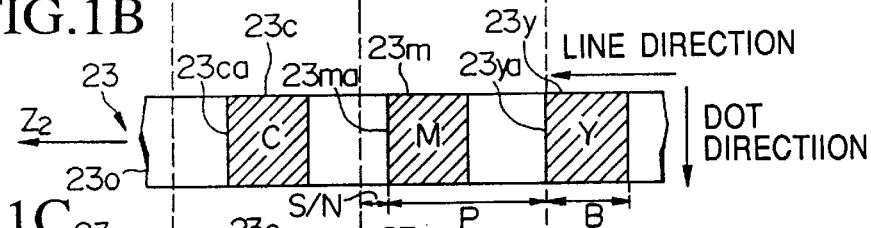

In FIG. 1B the multi time ink ribbon 23 has a substrate 23*o* with yellow ink 23*y*, magenta ink 23*m*, and cyan ink 23*c*, successively applied thereto at a pitch P, and with an ink effective length in the line width direction as B. The ink effective length B and the pitch P are respectively expressed by equations (1) and (2) below:

$$B=(L/N)+a \quad (1)$$

$$P=(L/N)+a+b \quad (2)$$

In equation (1), L represents the number of lines on the printing portion of the printing paper 1, while a represents an adjustment length for the ink effective portion. N is a ratio of a feed speed v1 of the multi time ink ribbon 23 to a conveying speed v2 of the printing paper 1, expressed by equation (3) as;

$$N=v2/v1 \quad (3)$$

In equation (2), b represents an ineffective length which depends on mechanical design requirements.

The abovementioned yellow ink 23*y*, magenta ink 23*m*, and cyan ink 23*c*, are made from respective sublimating type dye stuffs, with respective concentrations N time those for the conventional yellow ink of ink ribbon 3, magenta ink of ink ribbon 10 and cyan ink of ink ribbon 17, shown in FIG. 8.

In FIG. 1A, the feed reel 24 is positioned to the right of the Y head 2. The feed reel 24 is provided with a back tension mechanism (not shown) to thereby apply a constant tension to the multi time ink ribbon 23. The take-up reel 25 is positioned to the left of the C head 16 and is rotated by a drive apparatus (not shown The multi time ink ribbon 23 is wound around the feed reel 24 in the initial condition, and at the time of printing, is taken up by the take-up reel 25 via the guide rollers 26–33. As mentioned above, the feed speed v1 of the multi time ink ribbon 23 during take-up is 1/N times the conveying speed v2 of the printing paper 1.

Next is a description of the spacings S of the Y head 2, the M head 9 and the C head 16. The spacings S as shown in FIG. 1A are made the same as the length from an L1 line to an LS line of the printing paper 1, corresponding to the length for S lines. The relationship between the spacing S (S lines) and the pitch P of the multi time Ink ribbon 23 (see FIG. 1B), is expressed by equation (4) as:

$$P=S\ (1-(1/N)) \tag{4}$$

Substituting equation (2) into equation (4) and modify the spacing S relationship equation, gives spacing S expressed by equation (5) as:

$$S=(L+N\ (a+b))/(N-1) \tag{5}$$

Figure 2:
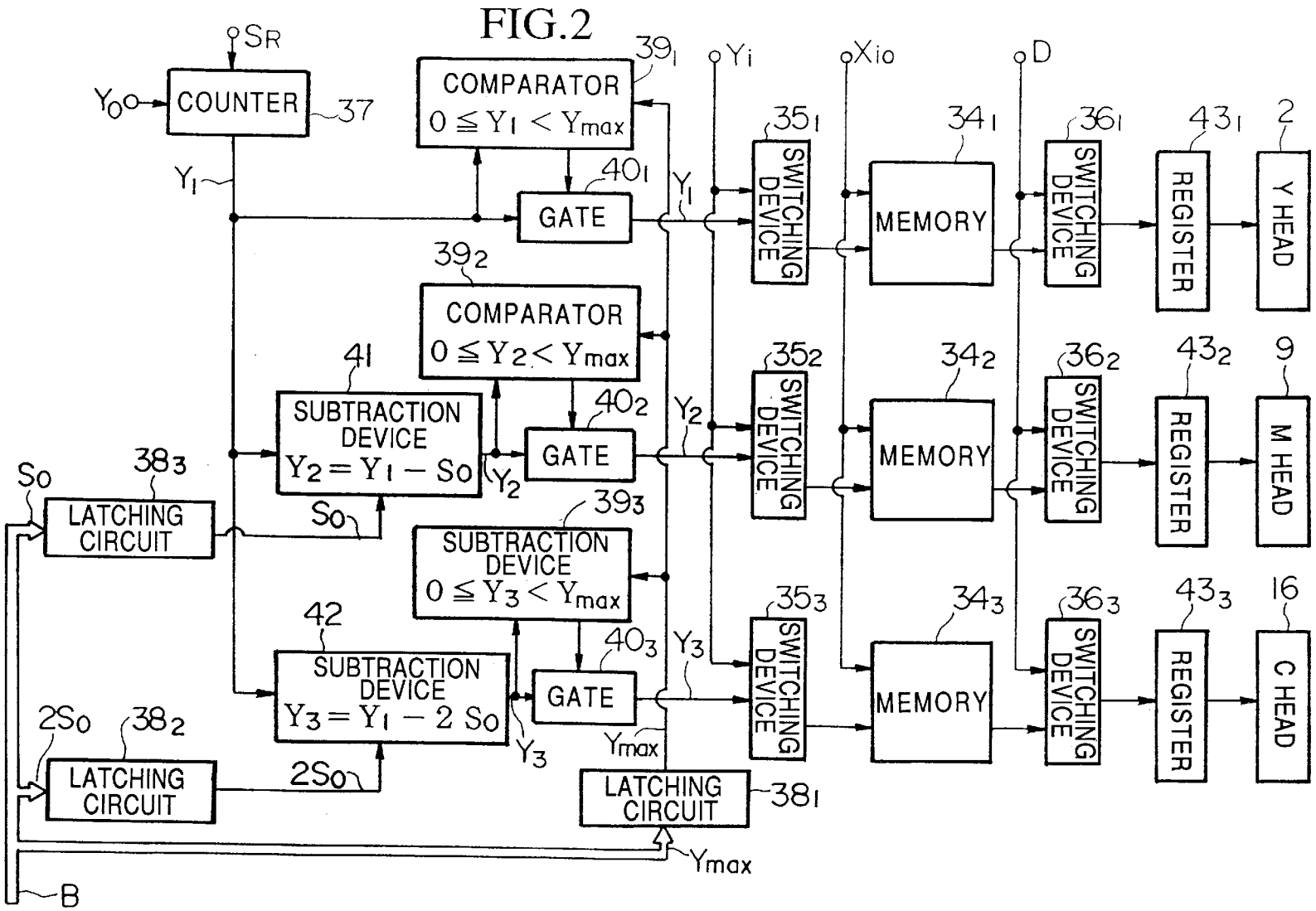
FIG. 2 is a block diagram showing a construction of a control section of the color printer according to the first embodiment.

Next, is a description of the construction of a control section of the color printer according to the first embodiment of the present invention with reference to FIG. 2. In FIG. 2 numerals $\mathbf{34}_1$–$\mathbf{34}_3$ indicate read/write memories respectively corresponding to the Y head 2, the M head 9 and the C head 16. At the time of writing to memory, printing data D is written to addresses in the memories $\mathbf{34}_1$–$\mathbf{34}_3$ specified by x address data Xio, and y address data Yi. The x address data Xio and the y address data Yi are data respectively showing the address in the dot direction and in the line direction shown in FIG. 1B.

At the time of reading from memory, printing data D which has been written into the addresses specified by the x address data Xio and the y address data Y1–Y3, is read from the memories $\mathbf{34}_1$–$\mathbf{34}_3$.

The writing/reading for the memories $\mathbf{34}_1$–$\mathbf{34}_3$ is carried out successively in the order of; printing data D for the L1 line, printing data D for the L2 line, and so on up to printing data D for the LL line.

Numerals $\mathbf{35}_1$–$\mathbf{35}_3$ indicate switching devices for switch control of the input of the address data to the memories $\mathbf{34}_1$–$\mathbf{34}_3$. At the time of writing the printing data D, when the y address data Yi is read, the y address data Y1–Y3 is respectively input to the memories $\mathbf{34}_1$–$\mathbf{34}_3$.

Numerals $\mathbf{36}_1$–$\mathbf{36}_3$ indicated switching devices for switch control of the input/output of the memories $\mathbf{34}_1$–$\mathbf{34}_3$. At the time of writing, the printing data D is respectively input to the memories $\mathbf{34}_1$–$\mathbf{34}_3$, and at the time of reading, the printing data D which has been written to the memories $\mathbf{34}_1$–$\mathbf{34}_3$, is output to registers $\mathbf{43}_1$–$\mathbf{43}_3$. With the registers $\mathbf{43}_1$–$\mathbf{43}_3$, each time the printing data D for one line is input thereto, this is respectively output to the Y head 2, the M head 9, and the C head 16.

Numeral 37 indicates a counter for counting up input y address pulses Yo, and outputting the count value as a y address data Y1. Here with the y address pulses Yo, one pulse is output for each one line advance of the printing paper 1. The y address data Y1 indicates the y address in the memory $\mathbf{34}_1$.

Numerals $\mathbf{38}_1$, $\mathbf{38}_2$ and $\mathbf{38}_3$ indicate latching circuits in which is respectively set address data Y max, data So, and data 2So from a CPU (central processing unit) not shown in the figure via a bus B. The address Y max is y address data for the memories $\mathbf{34}_1$–$\mathbf{34}_3$ in which is stored the print data for the LL line (last line) of the printing paper 1 shown in FIG. 1A. The data So is the number of lines for the spacing S between the Y head 2 and the M head 9 while the address data 2So is the number of lines for the spacing 2S between the Y head 2 and the C head 16.

Numeral $\mathbf{39}_1$ indicates a comparator, which opens a gate $\mathbf{40}_1$ only when the y address data Y1 is "0" or greater and less than "max", and closes the gate $\mathbf{40}_1$ under other conditions. Numeral 41 indicates a subtraction device, which subtracts data So from the y address data Y1, and outputs the result of the subtraction, being y address data Y2. This y address data Y2 specifies the y address in the memory $\mathbf{34}_2$. Numeral $\mathbf{39}_2$ indicates a comparator, which opens a gate $\mathbf{40}_2$ only when the y address data Y2 is "0" or greater and less than "Y max", and closes the gate $\mathbf{40}_2$ under other conditions.

Numeral 42 indicates a subtraction device, which subtracts address data 2So from the y address data Y1, and outputs the result of the subtraction, being y address data Y3. This y address data Y3 specifies the y address in the memory $\mathbf{34}_3$. Numeral $\mathbf{39}_3$ indicates a comparator, which opens a gate $\mathbf{40}_3$ only when the y address data Y3 (the subtraction result from the subtraction device 42) is "0" or greater and less than "Y max", and closes the gate $\mathbf{40}_3$ under other conditions.

Next is a description of the operation of the color printer, with reference to FIGS. 1 and 2.

<Writing Operation>

At first, is a description of the operation of writing the printing data D to the memories $\mathbf{34}_1$–$\mathbf{34}_3$. In FIG. 2, at first the CPU respectively sets the memory $\mathbf{34}_1$ to the write mode and the memories $\mathbf{34}_2$, $\mathbf{34}_3$ to the read modes. The memories $\mathbf{34}_2$, $\mathbf{34}_3$ are thus write inhibited. The CPU then outputs the x address data Xio to the memories $\mathbf{34}_1$–$\mathbf{34}_3$, and respectively outputs the y address data Yi, and the print data D to the memory $\mathbf{34}_1$ via the switching devices $\mathbf{35}_1$, $\mathbf{36}_1$. As a result, the print data D is successively written one line at a time to the addresses in the memory $\mathbf{34}_1$ specified by the x address data Xio and the y address data yi.

When the abovementioned operation of writing to memory $\mathbf{34}_1$ has been completed, the CPU respectively sets the memory $\mathbf{34}_2$ to the write mode, and the memories $\mathbf{34}_1$, $\mathbf{34}_3$ to the read modes. The CPU then outputs the x address data Xio to the memories $\mathbf{34}_1$–$\mathbf{34}_3$, and respectively outputs the y address data Yi, and the print data D to the memory $\mathbf{34}_2$ via the switching devices $\mathbf{35}_2$, $\mathbf{36}_2$. As a result, the print data D is successively written one line at a time to the addresses in the memory $\mathbf{34}_2$ specified by the x address data Xio and the y address data yi.

Then, when the operation of writing to the memory $\mathbf{34}_2$ has been completed, the CPU respectively sets the memory $\mathbf{34}_3$ to the write mode, and the memories $\mathbf{34}_1$, $\mathbf{34}_2$ to the read modes. The CPU then outputs the x address data Xio to the memories $\mathbf{34}_1$–$\mathbf{34}_3$, and respectively outputs the y address data Yi, and the print data D to the memory $\mathbf{34}_3$ via the switching devices $\mathbf{35}_3$, $\mathbf{36}_3$. As a result, the print data D is successively written one line at a time to the addresses in the memory $\mathbf{34}_3$ specified by the x address data Xio and the y address data Yi.

<Reading Operation>

Next is a description of the operation of reading the print data D which has been written to the memories $\mathbf{34}_1$–$\mathbf{34}_3$. At first, as shown in FIG. 1A the platen rollers 8, 15 and 22 are respectively rotated in the direction of arrow $Z_1$, so that the printing paper 1 is fed in the direction of arrow $Z_3$ by means of a feed roller (not shown). At the same time, the take-up reel 25 is rotated so that the multi time ink ribbon 23 is fed in the direction of arrow $Z_2$ At this time, the printing paper 1 is conveyed at a speed (conveying speed v2) of N times the feed speed v1 of the multi time ink ribbon 23.

Then, when the L1 line of the printing paper 1 and an edge 23*ya* of the yellow ink 23*y* of the multi time ink ribbon 23 are positioned immediately before the broken line y1, the CPU respectively sets the memories $\mathbf{34}_1$–$\mathbf{34}_3$ as shown in FIG. 2 to the read mode, and outputs the address data Y max and the data 2So, So to the latching circuits $\mathbf{38}_1$–$\mathbf{38}_3$ via the bus B. In this way, the address data Y max, and the data 2So, So are respectively set in the latching circuits $38_1$–$38_3$.

The CPU then respectively output a reset signal SR to the counter 37, and the x address data Xio to the memories $34_1$–$34_3$. The count value of the counter 37 is thus reset, and the counter 37 outputs the y address data Y1 ("0").

The subtraction device 41 subtracts data So from the y address data Y1 ("0"), and outputs the subtracted result as y address data Y2 ("−So"). The subtraction device 42 subtracts the data 2So from the y address data Y1, and outputs the subtracted result as y address data Y3 ("−2So").

Moreover, the comparator $39_1$ judges if the y address data Y1 is "0" or greater and less than "Y max". Since in this case, the y address data Y1 is "0", then the gate $40_1$ is opened. The y address data Y1 is then input to the memory $34_1$ via the gate $40_1$ and the switching device $35_1$. The other gates $40_2$, $40_3$ remain closed.

As a result the print data D for the L1 line of the printing paper 1 (see FIG. 1A) stored in the address specified by the y address data Y1 and the x address data Xio, is read from the memory $34_1$. This print data D is output to the register $43_1$ via the switching device $36_1$.

At this time, the L1 line of the printing paper 1 shown in FIG. 1A, and the edge 23*ya* of the yellow ink 23*y* of the multi time ink ribbon 23 (see FIG. 1B) are respectively positioned above the broken line y1. The Y head 2 is then lowered to press the multi time ink ribbon 23 against the platen 8 with the printing paper 1 therebetween. While pressing, the print data D is output from the register $43_1$ shown in FIG. 2 to the Y head 2. As a result, the heating element of the Y head 2 specified by the print data D is heated. Due to the heating of the heating element, the yellow ink 23*y* of the multi time ink ribbon 23 (see FIG. 1B) is melted, and yellow ink is printed on the L1 line of the printing paper 1.

Furthermore, the reset signal SR is input to the counter 37, after which the y address pulse Yo is successively input, and the counter 37 successively outputs the y address data Y1. After this, as with the abovementioned operation, the print data D for one line is successively read from the memory $34_1$ for each unit increment of the y address data Y1, so that the yellow ink is successively printed on the L2 and subsequent lines of the printing paper 1.

Figure 1C:
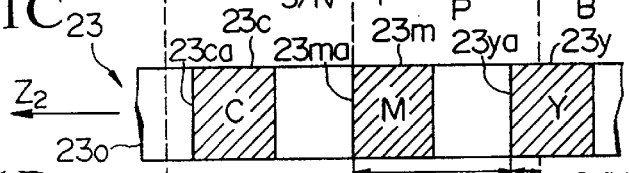

Then, when the L1 line of the printing paper 1 shown in FIG. 1A, and an edge 23*ma* of the magenta ink 23*m* of the multi time ink ribbon 23 as shown in FIG. 1C are together positioned above the broken line y2, the M head 9 is lowered to press the multi time ink ribbon 23 against the platen roller 15 with the printing paper 1 therebetween.

Since at this time, the y address data Y1 in FIG. 2 becomes "So", the y address data Y2 becomes "0", and the gate $40_2$ is opened by the comparator $39_2$. The y address data Y2 is thus successively output to the memory $34_2$ via the switching device $35_2$.

As a result, the print data D stored in the address specified by the y address data Y2 and the x address data Xio, is successively read from the memory $34_2$ one line at a time. This print data D is output to the register $43_2$ via the switching device $36_2$, and the register $43_2$ outputs the print data D to the M head 9. As a result, the heating element of the M head 9 specified by the print data D is heated so that the magenta ink 23*m* of the multi time ink ribbon 23 (refer to FIG, 1C) is melted. The magenta ink is thus printed over the yellow ink which has already been printed on the L1 line of the printing paper 1. Then by similar operations, the magenta ink is successively printed on the L2 and subsequent lines of the printing paper 1.

The yellow and magenta ink printing is then progressed, and when with the Y head 2 shown in FIG. 1A, the yellow ink has been printed on the LL line of the printing paper 1, then the y address data Y1 shown in FIG. 2 becomes "Y max" so that the comparator $39_1$ closes the gate $40_1$. As a result, all yellow ink printing is terminated.

Figure 1D:
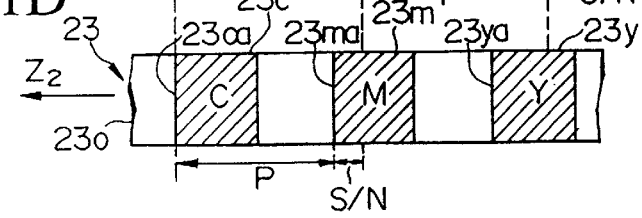

Then, when the L1 line of the printing paper 1 shown in FIG. 1A, and an edge 23*ca* of the cyan ink 23*c* of the multi time ink ribbon 23 as shown in FIG. 1D are together positioned above the broken line y3, the C head 16 is lowered to press the multi time ink ribbon 23 against the platen roller 22 with the printing paper 1 therebetween.

Since at this time, the y address data Y1 in FIG. 2 becomes "2So", the y address data Y3 becomes "0", and the gate $40_3$ is opened by the comparator $39_3$. The y address data Y3 is thus successively output to the memory $34_3$ via the switching device $35_3$.

As a result, the print data D stored in the address specified by the y address data Y3 and the x address data Xio, is successively read from the memory $34_3$ one line at a time. This print data D is output to the register $43_3$ via the switching device $36_3$, and the register $43_3$ outputs the print data D to the C head 16. As a result, the heating element of the C head 16 specified by the print data D is heated so that the cyan ink 23*c* of the multi time ink ribbon 23 (refer to FIG, 1D) is melted. The cyan ink is thus printed over the yellow and magenta inks which have already been printed on the L1 line of the printing paper 1. Then by similar operations, the cyan ink is successively printed on the L2 and subsequent lines of the printing paper 1.

The magenta and cyan ink printing is then progressed, and when with the M head 9 shown in FIG. 1A, the magenta ink has been printed on the LL line of the printing paper 1, then the y address data Y2 shown in FIG. 2 becomes "Y max" so that the comparator $39_2$ closes the gate $40_2$. As a result, all magenta ink printing is terminated.

The cyan ink printing is then progressed, and when with the C head 16 shown in FIG. 1A, the cyan ink has been printed on the LL line of the printing paper 1, then the y address data Y3 shown in FIG. 2 becomes "Y max" so that the comparator $39_3$ closes the gate $40_3$. As a result, all cyan ink printing is terminated.

With the color printer according to the first embodiment of the invention as described above, it is possible to print on one sheet of printing paper 1 over a line effective length B (=L/N)+a) for the yellow ink 23*y*, the magenta ink 23*m* and the cyan ink 23*c* of the multi time ink ribbon 23. As a result, the printing costs per sheet of printing paper 1 can be reduced.

For example, in the case of printing on an A4 sheet of printing paper (length 297*mm*), if the resolution in the subscanning direction is 12 lines/mm, then L=12×297=3564 lines, and if N=15, then the line effective length B (=L/N (disregarding a)) becomes 3564/15=(nearly equal) 238 lines. In other words 238/12=20 mm which is satisfactory.

Now with the first embodiment as described above, the example was given for a multi time ink ribbon 23 with 3 colors applied thereto; namely yellow, magenta, and cyan. However the construction is not limited to this, and a black ink may be added to the three colors to give 4 colors, and an additional thermal head for printing black provided.

Second Embodiment

Next is a description of the construction of a color printer according to a second embodiment of the present invention. The mechanical construction of the printing section of the color printer of the second embodiment is the same for the printing section shown in FIG. 9. However, with the color printer according to the second embodiment, instead of the color ink ribbon 51 as shown in FIG. 10, a multi time ink ribbon 60 shown in FIG. 3 is used.

Figure 3:
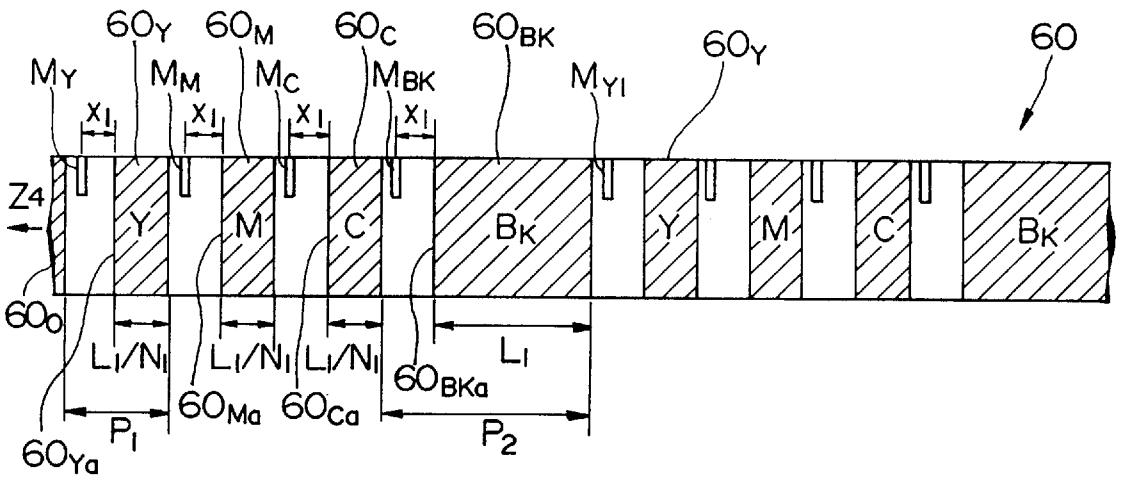
FIG. 3 is a plan view showing the construction of a multi time ink ribbon 60 used in the color printer according to a second embodiment of the present invention.

In FIG. 3, symbol 60Y indicates a yellow ink, which is applied to a band shaped substrate 60*o* with a width of the ink effective length of L1/N1. Here L1 is the longitudinal length of the card 58 shown in FIG. 9, while N1 is the ratio of a feed speed v11 of the multi time ink ribbon 60 to a conveying speed v22 of the card 58, expressed as v22/v11.

Letters $M_Y$ indicate a Y color mark formed on the substrate 60*o*, at a distance x1 from a front edge 60Ya of the yellow ink 60Y, being a mark for detection of the yellow ink 60Y. This Y color mark $M_Y$ is detected by the mark detection sensor 56 shown in FIG. 9. The distance x1 is equal to the distance (x1) between the heating section 50*a* of the thermal head 50 shown in FIG. 9, and the mark detection sensor 56.

Symbol 60M indicates magenta ink, which is applied to the substrate 60*o* with a width of the ink effective length L1/N1, in the same manner as for the yellow ink 60Y. Letters $M_M$ indicate an M color mark formed on the substrate 60*o* at a distance x1 from a front edge 60Ma of the magenta ink 60M, being a mark for detection of the magenta ink 60M.

Symbol 60C indicates cyan ink, which is applied to the substrate 60*o* with a width of the ink effective length L1/N1. Letters $M_C$ indicate a C color mark formed on the substrate 60*o* at a distance x1 from a front edge 60Ca of the cyan ink 60C, being a mark for detection of the cyan ink 60C.

The abovementioned yellow ink 60Y, magenta ink 60M, and cyan ink 60C, are made from respective sublimating type dye stuffs, with respective concentrations N1 times those for the conventional yellow ink 51Y, magenta ink 51M and cyan ink 51C, shown in FIG. 10.

In FIG. 3, symbol 60BK indicates black ink, which is applied to the substrate 60*o* with a width of the ink effective length L1, and is made from a mixture of carbon powder and wax (referred to hereunder as pigment), used for example in printing bar codes and the like. This black ink 60BK is a pigment material and is not concentrated as with the beforementioned sublimating dye stuffs (yellow ink 60Y etc.). Letters $M_{BK}$ indicate a BK color mark formed on the substrate 60*o* at a distance x1 from a front edge 60BKa of the black ink 60BK, being a mark for detection of the black ink 60BK.

In this way, the yellow ink 60Y, the magenta ink 60M, and the cyan ink 60C are successively applied to the substrate 60*o* at respective pitches P1, while the black ink 60BK is applied at a pitch P2. The pitch P1 is set slightly longer than (ink effective length L1/N1)+(distance x1). The pitch P2 is set slightly longer than (ink effective length L1)+(distance x1).

Figure 4:
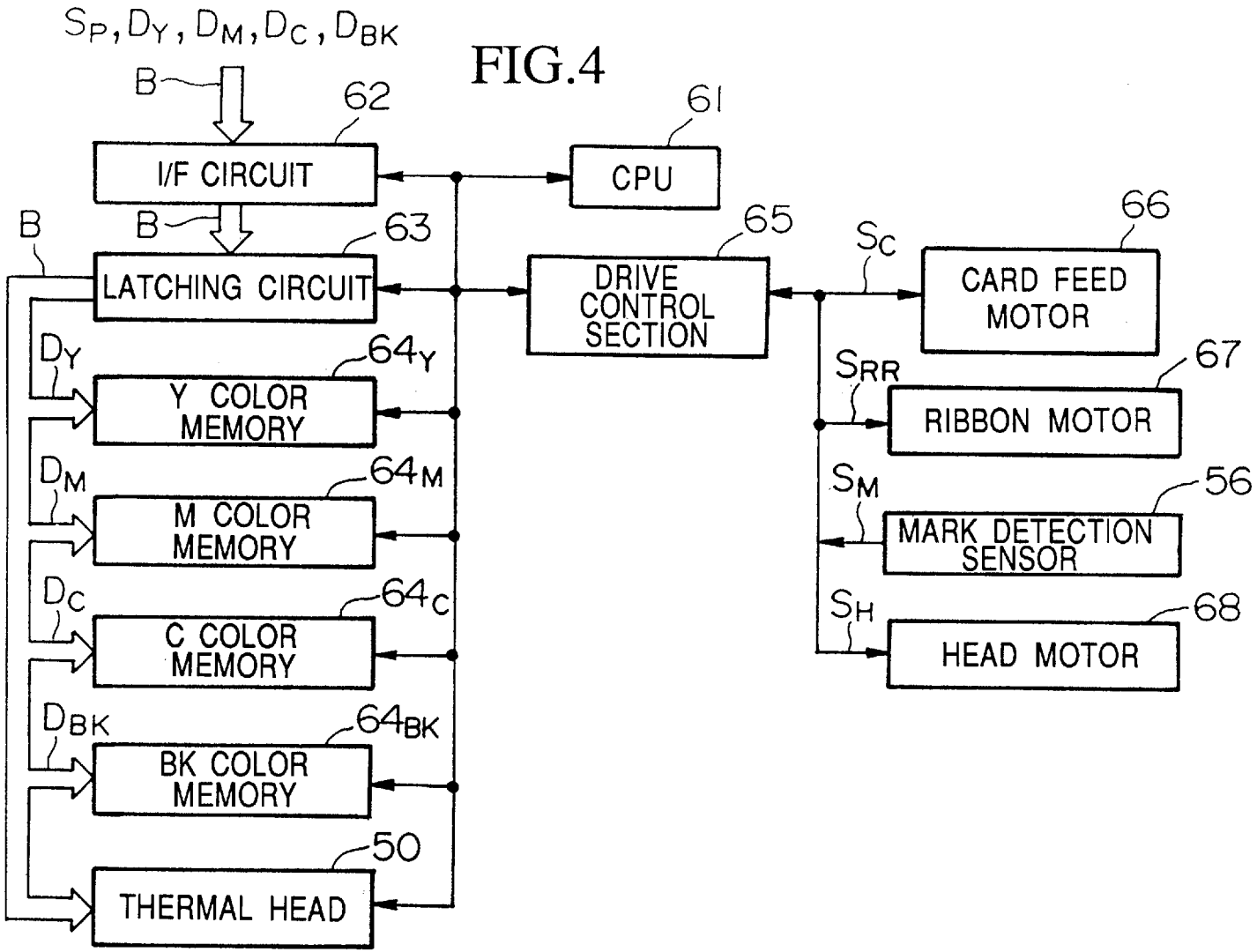
FIG. 4 is a block diagram showing a construction of a color printer control section according to the second embodiment.

FIG. 4 is a block diagram showing a structure of a control section of a color printer according to the second embodiment. In FIG. 4, numeral 61 indicates a CPU (central processing unit) for controlling the respective parts of the apparatus. Details of the operation of the CPU 61 are given later on. Numeral 62 indicates an I/F (interface) circuit for providing an interface between a computer (not shown) and the CPU 61. The I/F circuit 62 takes the yellow print data DY, the magenta print data DM, the cyan print data DC, the black print data DBK, and a print start signal Sp. The yellow print data DY, magenta print data DM, cyan print data DC, and black print data DBK are print data respectively corresponding to the colors (yellow, magenta, cyan and black) to be printed on the card 58 (refer to FIG. 9).

Numeral 63 indicates a latching circuit which, under control of the CPU 61, latches the abovementioned yellow print data DY, magenta print data DM, cyan print data DC, and black print data DBK. Symbol 64Y indicates a Y color memory for storing yellow print data DY latched by the latching circuit 63 under control of the CPU 61, and read in via a bus B. Symbol 64M indicates an M color memory for storing magenta print data DM. Numeral 64C indicates a C color memory for storing cyan print data DC. Symbol 64B indicates a BK color memory for storing black print data DBK.

Figure 9:
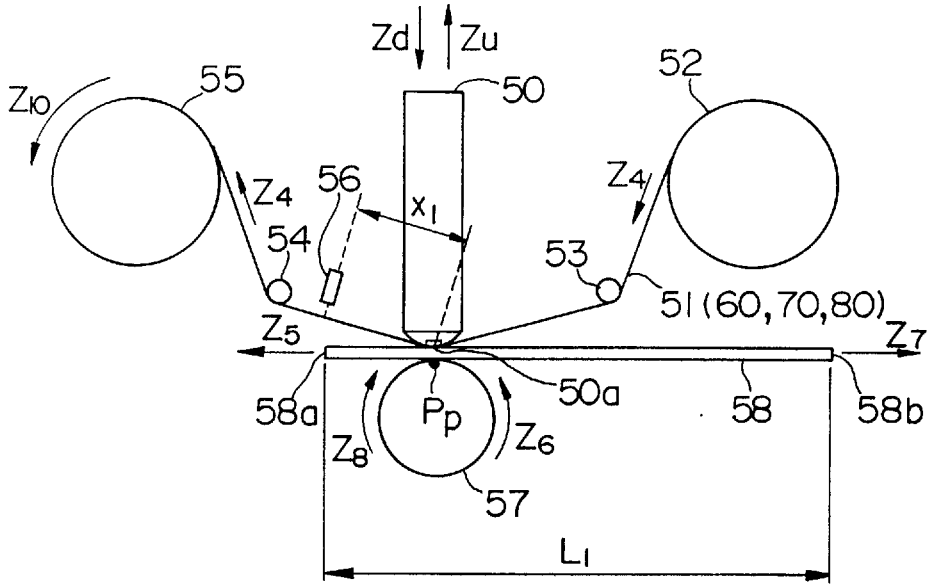
FIG. 9 is a side view showing an outline of the construction of a printing section of a conventional color printer (second construction example)
Figure 10:
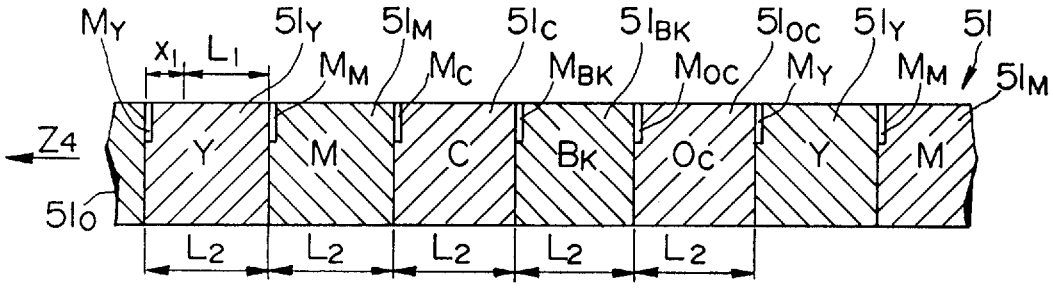
FIG. 10 is a plan view showing the construction of a color ink ribbon 51 used in the color printer shown in FIG. 9.

A thermal head 50 is the same as that shown in FIG. 9. Yellow print data DY, magenta print data DM, cyan print data DC, and black print data DBK are respectively supplied to the thermal head 50 from the Y color memory 64Y, the M color memory 64M, the C color memory 64C, and BK color memory 64BK.

Numeral 65 indicates a drive control section, which under the control command of the CPU 61, carries out drive control of the respective motors, namely a card feed motor 66, a ribbon motor 67, and a head motor 68. The card feed motor 66 drives a conveying apparatus (not shown) for conveying (or reverse conveying) the card 58 (refer to FIG. 9) held in a card holding case (not shown), to the platen roller 57 side. Drive power from the card feed motor 66 is transmitted to the platen roller 57 via a belt (not shown) The ribbon motor 67 in FIG. 4 rotates the take-up reel 55 shown in FIG. 9 in the direction of arrow $Z_{10}$. The head motor 68 moves the thermal heads 50 shown in FIG. 9 in the directions of arrow Zu (up) or in the direction of arrow Zd (down). The mark detection sensor 56 respectively detects the Y color Mark $M_Y$, the M color Mark $M_M$, the C color mark $M_C$ and the BK color mark $M_{BK}$ shown in FIG. 3, and outputs the detection results as mark detection signals SM.

Figure 5:
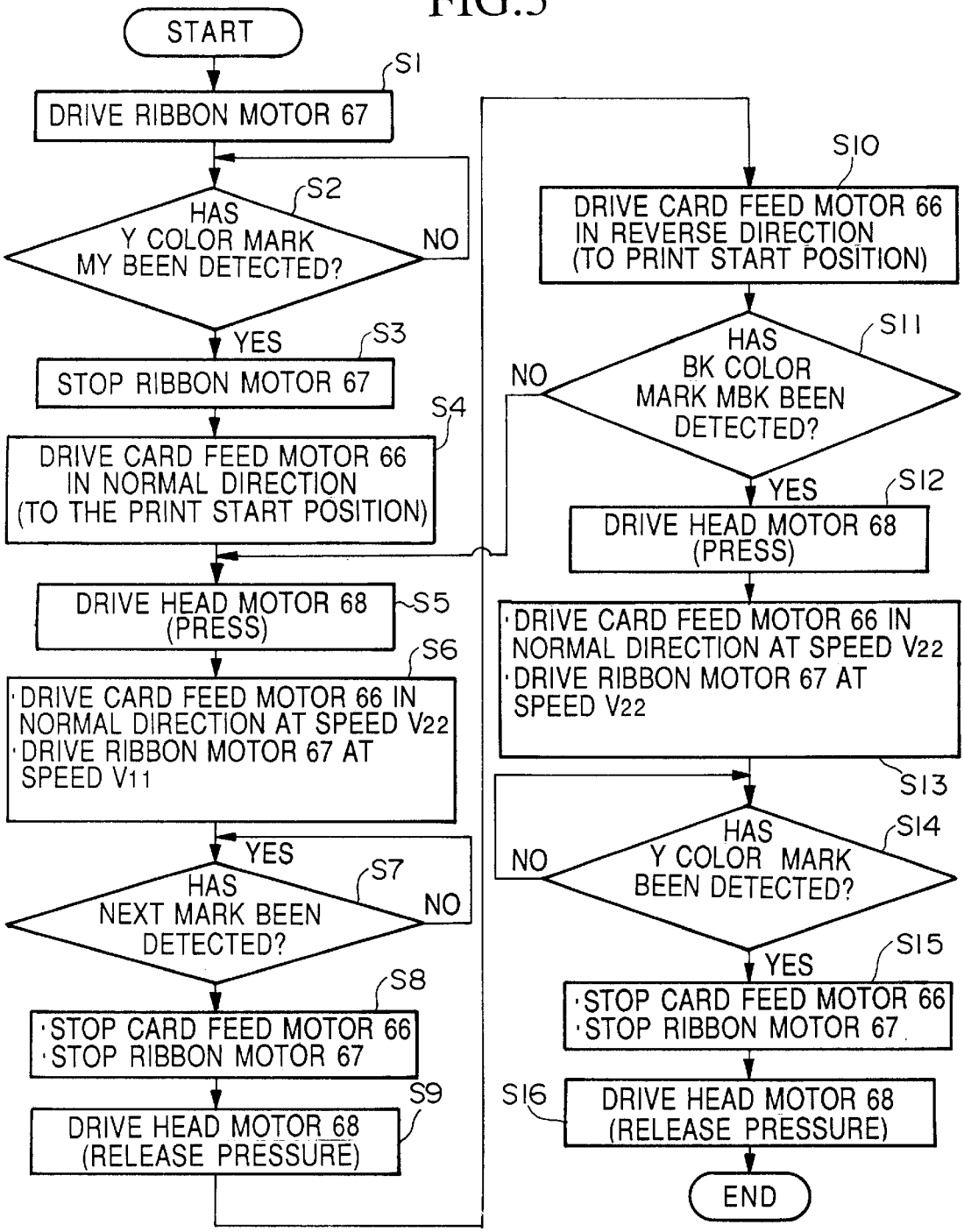
FIG. 5 is a flow chart showing the processing steps in the CPU 61 shown in FIG. 4.

Next is a description of the operation of the color printer of the second embodiment, with reference to FIGS. 3 through 5, and FIG. 9. FIG. 5 is a flow chart showing the processing steps in the CPU 61 shown in FIG. 4.

In FIG. 4, at first the print start signal Sp, the yellow print data DY, the magenta print data DM, the cyan print data DC and the black print data DBK, are input from the computer (not shown) via the I/F circuit 62. The CPU 61 then respectively sends the yellow print data DY, the magenta print data DM, the cyan print data DC, and the black print data DBK to the latching circuit 63 via the bus B for latching.

The CPU 61 then respectively writes from the latched data via the bus B, the yellow print data DY to the Y color memory 64Y, the magenta print data DM to the M color memory 64M, the cyan print data DC to the C color memory 64C, and the black print data DBK to the BK color memory 64BK.

Moreover, once the print start signal Sp has been input via the I/F circuit 62, the CPU 61 advances to step S1 shown in FIG. 5. In step S1 the CPU 61 executes the control command to the drive control section 65, to drive the ribbon motor 67 shown in FIG. 4, and then advances to step S2. A ribbon drive signal SRR is thus output from the drive control section 65 to the ribbon motor 67. As a result, the ribbon motor 67 is rotated so that the take-up reel 55 shown in FIG. 9, is rotated in the direction of arrow $Z_{10}$ to feed the multi time ink ribbon 60 in the direction of arrow $Z_4$.

In step S2 shown in FIG. 5, the CPU 61 judges whether or not the mark detection sensor 56 (refer to FIG. 9) has detected the Y color Mark $M_Y$ shown in FIG. 3. If the judgement result is "NO", then the CPU 61 repeats the same judgement. If the Y color mark My (refer to FIG.3) is currently positioned directly beneath the mark detection sensor 56 shown in FIG. 9, then the mark detection signal SM (refer to FIG. 4) is output from the mark detection sensor 56 to the CPU 61 via the drive control section 65. As a result, the CPU 61 advances to step S3 with the judgement results of step S2 shown in FIG. 5 as "YES".

In step S3, the CPU 61 executes the control command to the drive control section 65 to stop the ribbon motor 67, and then advances to step S4. The drive control section 65 thus stops outputting the ribbon drive signal SRR. As a result, the ribbon motor 67 is stopped so that movement of the multi time ink ribbon 60 stops. That is to say, the multi time ink ribbon 60 shown In FIG. 9 stops with the Y color Mark $M_Y$ (refer to FIG. 3) positioned directly beneath the mark detection sensor 56, and the front edge 60Ya of the yellow ink 60Y positioned directly beneath the heating section 50*a* of the thermal head 50.

In step S4, the CPU 61 executes a control command to the drive control section 65 to drive the card feed motor 66 in the normal direction. A card drive signal SC is thus output from the drive control section 65 to the card feed motor 66. As a result, the card feed motor 66 is rotated in the normal direction so that the card 58 shown in FIG. 9 is conveyed in the direction of arrow $Z_5$ by the conveying apparatus (not shown). Then, when the front edge 58*a* of the card 58 is positioned at the print start position Pp, the drive control section 65 shown in FIG. 4 stops outputting the card drive signal SC.

When the output of the card drive signal SC stops, the CPU 61 advances to step S5 shown in FIG. 5.

In step S5, the CPU 61 executes the control command to the drive control section 65, to drive the head motor 68 in the normal direction, and then advances to step S6. A head drive signal SH is thus output from the drive control section 65 shown in FIG. 4, to the head motor 68. As a result, the thermal head 50 shown in FIG. 9 is lowered in the direction of arrow Zd so that the vicinity of the front edge 58*a* of the card 58 is pressed.

In step S6, the CPU 61 executes the control command to the drive control section 65, to respectively drive the card feed motor 66 and the ribbon motor 67 in the normal direction, and successively outputs one line at a time, the yellow print data DY stored in the Y color memory 64Y shown in FIG. 4, to the thermal head 50, and then advances to step S7. In this case, the rotation speed of the card feed motor 66 is made such that the conveying speed of the card 58 becomes v22. Moreover the rotation speed of the ribbon motor 67 is made such that the feed speed of the multi time ink ribbon 60 becomes v11 (=v22/N1).

The card feed motor 66 and the ribbon motor 67 are thus respectively rotated so that the platen roller 57 and the take-up reel 55 shown in FIG. 9 are rotated. As a result the multi time ink ribbon 60 is fed in the direction of arrow $Z_4$ at a feed speed v11 and the card 58 is conveyed in the direction of arrow $Z_5$ at a conveying speed v22. Moreover the heating element 50*a* of the thermal head 50 is heated in accordance with the yellow print data DY so that the yellow ink 60Y (refer to FIG. 3) melts. Yellow ink is thus successively printed on the surface of the card 58, one line at a time from the front edge 58*a* to the rear edge 58*b*.

In step S7, the CPU 61 judges whether or not the mark detection sensor 56 has detected the next mark (in the present case, the M color mark $M_M$ shown in FIG. 3). That is to say whether or not a mark detection signal SM has been input. If the judgement result is "NO", then the CPU 61 repeats the same judgement. If yellow ink printing has been progressed and the M color mark $M_M$ shown in FIG. 3 is currently positioned directly beneath the mark detection sensor 56 shown in FIG. 9, then the mark detection signal SM is output from the mark detection sensor 56. As a result, the CPU 61 advances to step S8 with the judgement results of step S7 as "YES". At this time, the rear edge 58*b* of the card 58 in FIG. 9 is positioned at the print start Position Pp.

In step S8, the CPU 61 executes the control command to the drive control section 65 to stop the card feed motor 66 and the ribbon motor 67, and then advances to step S9. The drive control section 65 thus stops outputting the card drive signal SC and the ribbon drive signal SRR. As a result, the card feed motor 66 and the ribbon motor 67 are stopped. That Is to say, movement of the multi time ink ribbon 60 and the card 58 shown in FIG. 9 is stopped In step S9, the CPU 61 executes the control command to the drive control section 65, to drive the head motor 68 in the reverse direction, and then advances to step S10. The head drive signal SH is thus output from the drive control section 65 to rotate the head motor 68 in the reverse direction. As a result, the thermal head 50 shown in FIG. 9 is raised in the direction Zu so that the pressure on the card 58 is released.

In step S10, the CPU 61 executes a control command to the drive control section 65 to rotate the card feed motor 66 in the reverse direction, and then advances to step S11. A card drive signal SC is thus output from the drive control section 65 to rotate the card motor 66 in the reverse direction, and rotate the platen roller 57 shown in FIG. 9 in the direction of arrow $Z_8$. As a result the card 58 is conveyed in the reverse direction shown by arrow $Z_7$.

Then, when the front edge 58*a* of the card 58 is positioned at the print start Position Pp, the drive control section 65 stops outputting the card drive signal SC. The card 58 is thus ready for printing of the next color (magenta).

In step S11, the CPU 61 judges whether or not the mark detection sensor 56 has detected the BK mark (refer to FIG. 3) in step S7. In the present case the mark detection sensor 56 detects the M color mark $M_M$ (see FIG. 3), and hence the CPU 61 gives a judgement result of "NO", and returns to step S5 to repeat the above steps.

That is to say, in step S5, the thermal head 50 shown in FIG. 9 is lowered in the direction of arrow Zd. Then in step S6, magenta print data DM is output successively one line at a time from the M color memory 64M shown in FIG. 4, to the thermal head 50, and the card 58 is conveyed in the direction of arrow $Z_5$ at a conveying speed v22, and the multi time ribbon 60 is fed in the direction of arrow $Z_4$ at a feed speed v11 (=v22/N1). Magenta ink 60M (see FIG. 3) is thus successively printed one line at a time on the surface of the card 58.

In step 7, the C color mark $M_C$ shown in FIG. 3 is detected by the mark detection sensor 56 shown in FIG. 9, and in step S8, the conveying of the card 58 and the feed of the multi time ribbon 60 is stopped. Then in step S9, the thermal head 50 shown in FIG. 9 is raised in the direction of arrow Zu so that the pressure on the card 58 is released. In step S10, the card 58 is conveyed in a reverse direction until the front edge 58*a* is positioned at the print start Position Pp. Then in step S11, since the C color mark $M_C$ is detected in step 7, the CPU 61 gives a judgement result of "NO", and returns to step S5 to carry out printing of the cyan color 60C.

Then when in step S7, the BK color mark $M_{BK}$ shown in FIG. 3 is detected by the mark detection sensor 56, the CPU advances to step S12 with the judgement result of step S11 as "YES". In step S12, the CPU 61 then executes the control command to the drive control section 65, to drive the head motor 68 in the normal direction, and then advances to step S13. A head drive signal SH is thus output from the drive control section 65 shown in FIG. 4, to the head motor 68. As a result, the thermal head 50 shown in FIG. 9 is lowered in the direction of arrow Zd so that the vicinity of the front edge 58*a* of the card 58 is pressed.

In step S13, the CPU 61 successively outputs one line at a time, the black print data DBK from in the BK color memory 64BK shown in FIG. 4, to the thermal head 50. However, the data output speed of the black print data DBK is 1/N1 times that of the yellow print data DY. The CPU 61 also executes the control command to the drive control section 65, to drive the card feed motor 66, and the ribbon motor 67, and then advances to step S14.

As a result, the card drive signal SC and the ribbon drive signal SRR are respectively output from the drive control section 65. In this way, the take-up roller 55 and the platen roller 57 shown in FIG. 9 are rotated so that the multi time ink ribbon 60 is fed in the direction of arrow $Z_4$ at a feed speed v22, and the card 58 is conveyed in the direction of arrow $Z_5$ at a conveying speed v22. That is to say, the multi time ink ribbon 60 and the card 58 are conveyed at the same speed v22, and the black ink 60BK (see FIG. 3) is successively printed one line at a time on the surface of the card 58.

Then in step S14, the CPU 61 judges whether or not the mark detection sensor 56 has detected the next Y color mark $M_{Y1}$ (see FIG. 3). If the judgement result is "NO", the judgement is repeated.

The printing with the black ink 60BK is then progressed, and when the rear edge 58*b* of the card 58 shown in FIG. 9 is positioned at the print start Position Pp, and the Y color mark $M_Y$ shown In FIG. 3 is positioned directly beneath the detection sensor 56 shown in FIG. 9, then the mark detection signal SM (corresponding to the Y color mark $M_{Y1}$) is output from the mark detection sensor 56. As a result, the CPU 61 advances to step S15 with the judgement results of step S14 as "YES".

In step S15, the CPU 61 executes the control command to stop the card feed motor 66 and the ribbon motor 67, and then advances to step S16. The drive control section 65 thus stops outputting the card drive signal SC and the ribbon drive signal SRR.

In step S16, the CPU 61 executes the control command to the drive control section 65, to d rive the head motor 68 in the reverse direction. The head drive signal SH is thus output from the drive control section 65, so that the thermal head 50 shown in FIG. 9 is raised in the direction Zu to thus release the pressure. That is to say the four color ink printing on the card 58 is completed.

With the color printer of the second embodiment as described above, a multi time ink ribbon 70 shown in FIG. 6 may be used instead of the multi time ink ribbon 60 shown in FIG. 3 (first variation example). With the multi time ink ribbon 70 shown in FIG. 6, the same symbols are used to indicate parts corresponding to those of FIG. 3, and description is omitted.

Figure 6:
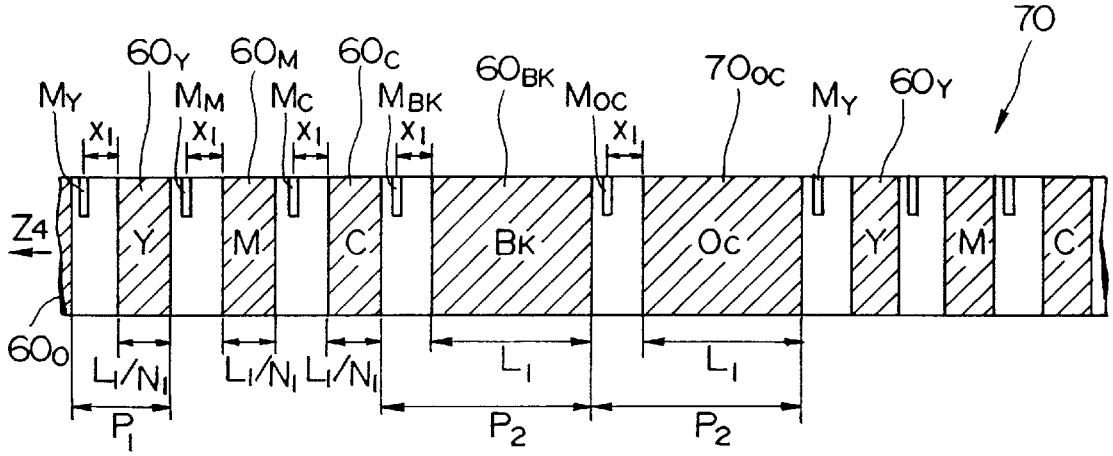
FIG. 6 is a plan view showing the construction of a multi time ink ribbon 70 used in the color printer according to a first variation example of the second embodiment of the present invention.

In FIG. 6, overcoat material 700C is applied to the substrate 60*o* between the black ink 60BK and the yellow ink 60Y at a pitch P2. Moreover an OC mark $M_{OC}$ for detecting the overcoat material 700C is formed between the overcoat material 700C and the black ink 60BK. The overcoat material 700C is used for example to stop wear of the ink printed on the surface of the card 58, and to prevent color fade due to ultraviolet rays.

When the multi time ink ribbon 70 shown in FIG. 6 is used, then in step S11 shown in FIG. 5, the CPU 61, in addition to detecting whether or not the BK color mark $M_{BK}$ has been detected must also detect whether or not the OC mark $M_{OC}$ (see FIG. 6) has been detected. That is to say, when in step S11 the OC mark $M_{OC}$ is detected, the CPU advances to step S12.

In other words, with the color printer according to the first variation example, the overlay printing is carried out on the card 58 in the order of; yellow ink 60Y→magenta ink 60M→cyan ink 60C→black ink 60BK→overcoat material 700C.

Figure 7:
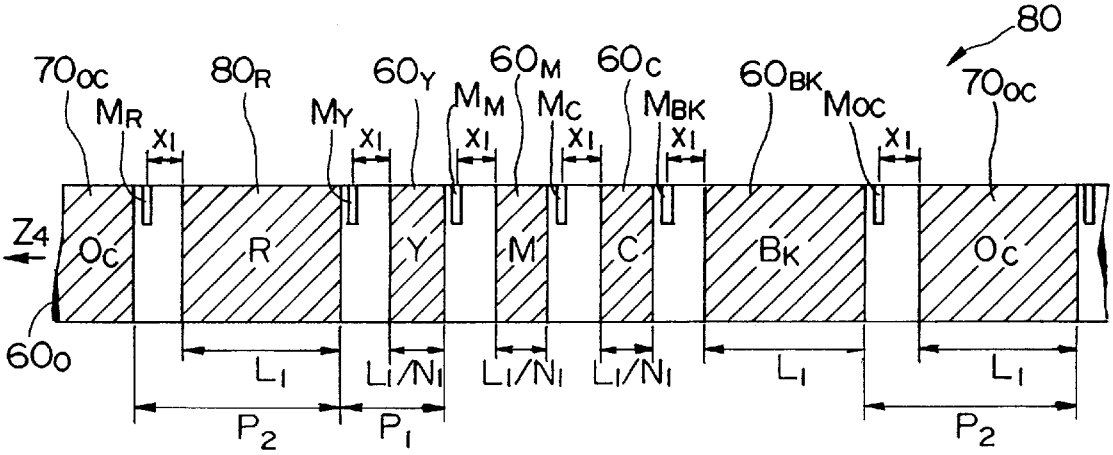
FIG. 7 is a plan view showing the construction of a multi time ink ribbon 80 used in the color printer according to a second variation example of the second embodiment of the present invention.

Moreover, with the color printer according to the second embodiment, a multi time ink ribbon 80 shown in FIG. 7 may be used instead of the multi time ink ribbon 60 shown in FIG. 3 (second variation example). With the multi time ink ribbon 80 shown in FIG. 7, the same symbols are used to indicate parts corresponding to those of FIG. 3 and FIG. 6, and description is omitted.

In FIG. 7, a receptor material 80R is applied to the substrate 60*o* between the overcoat material 700C and the yellow Ink 60Y at a pitch P2. Moreover a receptor material mark $M_R$ for detecting the receptor material 80R is formed between the receptor material 80R and the overcoat material 700C. The receptor material 80R is for Improving fixing of the sublimating type ink. Consequently if the card 58 material is PET or PPS, then the multi time ink ribbon 80 shown in FIG. 7 is used.

When the multi time ink ribbon 80 shown in FIG. 7 is used, then in step S11 shown in FIG. 5, the CPU 61, in addition to detecting whether or not the BK color mark $M_{BK}$ has been detected must also detect whether or not the OC mark $M_{OC}$ and the receptor material mark $M_R$ (see FIG. 7) have been detected. That is to say, when in step S11 the black color mark $M_{BK}$, the OC mark $M_{OC}$, or the receptor material mark $M_R$ is detected, the CPU 61 advances to step S12.

With the color printer according to the second embodiment as described above, the example has been given for when the mark detection sensor 56 (see FIG. 9) is used. However instead of this, a visible light sensor which can distinguish between the ink colors can be used. When such a visible light sensor is used, then the marks such as the Y color Mark $M_Y$ (see FIG. 3) are not required.

Moreover, with the color printer according to the second embodiment as described above, the example has been given for a swing method wherein the card 58 is returned to the print start Position Pp each time printing of one color can been completed, ready to print the next color. However the invention is not limited to this, and a rotation method wherein the printing is carried out by rotating the card 58 in one direction is also possible.

Furthermore, with the color printer according to the second embodiment as described above, the example has been given for when a single thermal head 50 is used. However the invention is not limited to this, and a plurality of thermal heads may be used.

With the present invention as described above, a plurality of colors may be printed with one type of ink ribbon. Hence ink ribbon replacement maintenance is easy, and the color printer can be made small since the three types of ink ribbon of the conventional color printer are not required.

Moreover, with the present invention, since one sheet of printing paper can be printed with a length of the ink region of 1/N or slightly greater than 1/N of the length of the printing portion of the printing paper (object to be printed), then printing costs can be reduced.

Moreover, with the present invention, even if printing with incompressible pigment type ink is required, since compressible type sublimating ink is used, then printing costs can be reduced.

What is claimed is:

1. A color printer comprising:

a plurality of thermal heads arranged at predetermined spacing along a printing paper direction;

a single ink ribbon with a plurality of ink regions respectively corresponding to said plurality of thermal heads successively located on said ink ribbon with a feed direction length of the respective ink regions being 1/N, where N is a positive integer, of a length of a printing portion of said printing paper; and conveying means for conveying said printing paper at a predetermined conveying speed and conveying said ink ribbon at a speed of 1/N of the conveying speed of said printing paper.

2. A color printer as claimed in claim 1, wherein the concentration of ink on said ink ribbon is N times the normal concentration.

3. A color printer as claimed in claim 2, wherein a spacing S between said plurality of thermal heads is $$S=\{L+N(a+b)\}/(N-1),$$

where:

L is a converted line number length for the printing portion of the printing paper, a is an ink adjustment length, and b is an ineffective length which depends on mechanical design conditions.

4. A color printer as claimed claim 1, wherein a spacing S between said plurality of thermal heads is $$S=\{L+N\ (a+b)\}/(N-1),$$

where:

L is a converted line number length for the printing portion of the printing paper, a is an ink adjustment length, and b is an ineffective length which depends on mechanical design conditions.

5. A color printer as claimed in claim 1, further comprising:

a plurality of storage means respectively corresponding to said plurality of thermal heads for storing printing data, and control means for reading said printing data in said storage means in synchronism with the conveying of said printing paper, and outputting said printing data to said plurality of thermal heads.

6. A color printer as claimed in claim 5, wherein a spacing S between said plurality of thermal heads is $$S=\{L+N(a+b)\}/(N-1),$$

where:

L is a converted line number length for the printing portion of the printing paper, a is an ink adjustment length, and b is an ineffective length which depends on mechanical design conditions.

7. A color printer comprising:

a thermal head arranged along a feed direction of an object to be printed on a printing paper;

an ink ribbon having a plurality of sublimating type and pigment type ink regions successively positioned thereon with a feed direction length of a said sublimating type ink region being 1/N where N is a positive integer, of a length of a printing portion of said object to be printed, and a feed direction length of a said pigment type ink region being N times the feed direction length of a said sublimating type ink region;

conveying means for conveying the printing paper at a predetermined conveying speed, for conveying said ink ribbon at a speed of 1/N of the conveying speed of the printing paper when said sublimating type ink is being printed on the printing paper, and for conveying said ink ribbon at the same speed as the conveying speed of the printing paper when said pigment type ink is being printed on the printing paper.

8. A color printer as claimed in claim 7, wherein an overcoat material for protecting the printing is located on said ink ribbon over a region of at least the length of the printing portion of said object to be printed;

and wherein said conveying means conveys said ink ribbon at substantially the same speed as the conveying speed of the printing paper when said overcoat material is being printed on the printing paper.

9. A color printer as claimed in claim 7, wherein a fixing material for increasing the fixing strength of said sublimating type ink is located on said ink ribbon over a region of at least the same length as the printing portion of said object to be printed, and said conveying means conveys said ink ribbon at substantially the same speed as the conveying speed of the printing paper when said fixing material is being printed on the printing paper.

10. A color printer comprising:

A color printer comprising:

a thermal head arranged along a feed direction of an object to be printed on a printing paper;

an ink ribbon with a plurality of sublimating type and pigment type ink regions successively located thereon with a feed direction length of a said sublimating type ink region being 1/N where N is a positive integer, of a length of said object to be printed, and a feed direction length of a said pigment type ink region being N times the feed direction length of a said sublimating type ink region;

conveying means for conveying the printing paper at a predetermined conveying speed, for conveying said ink ribbon at a speed of 1/N of the conveying speed of the printing paper when said sublimating type ink is being printed on the printing paper, and for conveying said ink ribbon at the same speed as the conveying speed of the printing paper when said pigment type ink is being printed on the printing paper;

a plurality of storage means for storing printing data; and control means for reading said printing data in said storage means in synchronism with the conveying of said object to be printed, and outputting said printing data to said thermal head.

11. A color printer comprising:

a thermal head arranged along a feed direction of an object to be printed on a printing paper;

an ink ribbon having a plurality of sublimating type and pigment type ink regions successively positioned thereon with a feed direction length of a said sublimating type ink region being 1/N, where N is a positive integer, of a length of a printing portion of said object to be printed, and a feed direction length of a said pigment type ink region being N times the feed direction length of a said sublimating type ink region;

conveying means for conveying the printing paper at a predetermined conveying speed, for conveying said ink ribbon at a speed of 1/N of the conveying speed of the printing paper when said sublimating type ink is being printed on the printing paper, and for conveying said ink ribbon at the same speed as the conveying speed of the printing paper when said pigment type ink is being printed on the printing paper;

judgment means for judging which of said sublimating type ink and said pigment type ink is to be printed;

a plurality of storage means for storing printing data; and control means for reading said printing data in said storage means in synchronism with the conveying of the printing paper, and outputting said printing data to said thermal head, and said conveying means conveys said ink ribbon based on the judgment results of said judgment means.

12. A color printer comprising:

a thermal head arranged along a feed direction of an object to be printed on a printing paper;

an ink ribbon having a plurality of sublimating type and pigment type ink regions successively positioned thereon with a feed direction length of a said sublimating type ink region of 1/N, where N is a positive integer, of a length of a printing portion of said object to be printed, and a feed direction length of a said pigment type ink region of at least N times the feed direction length of a said sublimating type ink region;

conveying means for conveying the printing paper at a predetermined conveying speed, for conveying said ink ribbon at a speed of 1/N of the conveying speed of the printing paper when a said sublimating type ink is being printed on the printing paper, and for conveying said ink ribbon at the same speed as the conveying speed of the printing paper when said pigment type ink is being printed on the printing paper;

judgment means for judging which of said sublimating type ink and said pigment type ink is to be printed;

a plurality of storage means for storing printing data; and control means for reading said printing data in said storage means in synchronism with the conveying of the printing paper, and outputting said printing data to said thermal head, an overcoat material for protecting the printing surface of the printing paper on said ink ribbon in a region over at least the same length as the printing portion of said object to be printed, and said conveying means conveys said ink ribbon based on the judgment results of said judgment means.

13. A color printer comprising:

a thermal head arranged along a feed direction of an object to be printed on a printing paper;

an ink ribbon with a plurality of sublimating type and pigment type ink regions successively located thereon with a feed direction length of a said sublimating type ink region of 1/N, where N is a positive integer, of a length of a printing portion of said object to be printed, and a feed direction length of said pigment type ink region of at least N times the feed direction length of a said sublimating type ink region;

conveying means for conveying the printing paper at a predetermined conveying speed, for conveying said ink ribbon at a speed of 1/N of the conveying speed of the printing paper when a said sublimating type ink is being printed on the printing paper, and for conveying said ink ribbon at the same speed as the conveying speed of the printing paper when a said pigment type ink is being printed on the printing paper;

judgment means for judging which of said sublimating type ink and said pigment type ink is to be printed;

a plurality of storage means for storing printing data; and control means for reading said printing data in said storage means in synchronism with the conveying of the printing paper, and outputting said printing data to said thermal head, a fixing material for increasing the fixing strength of said sublimating type ink on said ink ribbon over a region of at least the same length as the printing portion of said object to be printed, and said conveying means conveys said ink ribbon based on the judgment results of said judgment means.

14. An ink ribbon comprising:

a band shape base material;

a plurality of sublimating type and pigment type ink regions positioned successively on said base material with a feed direction length of a said sublimating type ink region of 1/N where N is a positive integer, of a length of a printing portion of an object to be printed and a feed direction length of a said pigment type ink region of N times the feed direction length of a said sublimating type ink region.

15. A color printer as claimed in claim 14, further comprising:

judgment means for judging which of said sublimating type ink and said pigment type ink is to be printed on the printing paper, and said conveying means conveys said ink ribbon based on the judgment results of said judgment means.

* * * * *